US005335950A

United States Patent [19]

Mirshafiee et al.

[11] Patent Number: 5,335,950

[45] Date of Patent: Aug. 9, 1994

[54] DOOR LOCKSET WITH SPINDLE BEARING

[75] Inventors: David Mirshafiee, Fountain Valley; Gary R. Bergen, Yorba Linda, both of Calif.

[73] Assignee: Emhart Inc., Newark, Del.

[21] Appl. No.: 928,585

[22] Filed: Aug. 13, 1992

[51] Int. Cl.[5] ..... E05B 15/02

[52] U.S. Cl. ..... 292/356; 292/169.23

[58] Field of Search ..... 292/169, 169.23, 169.14, 292/356, 357, 347, 359

[56] References Cited

U.S. PATENT DOCUMENTS 1,516,152 11/1924 Dumont .
1,668,403 5/1928 Haven .
1,904,210 4/1933 Eichel, Jr. ..... 292/356
2,461,085 2/1949 Roy ..... 292/356 X
2,657,567 11/1953 Young .
2,741,502 4/1956 Crandell ..... 292/169.23
3,014,748 12/1961 Welch et al. ..... 292/356
3,020,073 2/1962 Williams .
3,621,685 11/1971 Sargent .
3,955,387 5/1976 Best et al. .
4,012,929 3/1977 Solovieff .
4,195,502 4/1980 Best et al. .
4,312,201 1/1982 Roos .
4,338,804 7/1982 Solovieff .
4,550,581 11/1985 Best et al. .
4,655,059 4/1989 Best et al. .
4,679,420 7/1987 Yang .

*Primary Examiner*—Rodney M. Lindsey
*Attorney, Agent, or Firm*—J. Bruce Hoofnagle

[57] ABSTRACT

A lockset 20 includes an interior knob 24 mounted on an insert 26 and an exterior knob 62 mounted on an insert 64. A rose liner 30 and a cover 58 are mounted on the insert and provide a spaced bearing support for an interior assembly including knob 24. A rose liner 70 is mounted on insert 64 and combines with a security shield 146 and bearing 148 to provide a spaced bearing support for an exterior assembly including knob 62. Knob 62 is assembled with insert 64 through dimples 164 and projections 168 to allow slippage of the knob on the insert upon the application of excessive force without destruction of elements of lockset 20.

20 Claims, 5 Drawing Sheets 148
212
220
159
218
214
158
159

220
218
158
159
159
212
214
148

188
194
196
190
186
58
194
196

154
152
156
150
210

194
198
196
192
188
190
186
58
194
198
196

154
165
167
161
161
150
209
210
210
209
146
156
154

163

DOOR LOCKSET WITH SPINDLE BEARING

BACKGROUND OF THE INVENTION

This invention relates to a door lockset with a spindle bearing and particularly relates to a door lockset with structure for enhancing bearing support for various components of the lockset.

In some currently available locksets which are designed for assembly with doors, some of the structural components within the lockset, while adequately supported, are not supported in a sturdy manner. This results in sagging and/or wobble of the door operator or knob relative to the door and also places significant stresses on those bearing surfaces which are included within such locksets. This could result in significant wear of the existing bearing surfaces and adjacent elements and potential early demise of the lockset.

Typically, a door is prepared with a through hole for subsequent receipt of interior portions of the lockset. Fastening screws are used to retain the interior portions of the lockset within the hole as well as to retain, with the door, those portions of the lockset on opposite exterior portions of the door. If the screws are not tightened firmly, or if the screws loosen later, the lockset tends to slip downwardly and thereby sag. This could result in exposure of a portion of the hole in the door which becomes unsightly. Even worse, the exposed hole would allow someone without authority to place an implement into the hole and operate the latch mechanism or directly manipulate the bolt. Certainly, the unsightly appearance of the hole and the opportunity for unauthorized access to the interior of the lockset is unacceptable.

Still further, some currently available door knobs include a sleeve which is staked to a mating sleeve of a knob insert. If forced entry is attempted by twisting the knob beyond the ability of the staked elements, certain elements could be destroyed and thereby require costly replacement thereof.

In light of the above-noted limitations, there is a need for a door lockset which provides for sturdy support of the elements of the lockset, lessens the opportunity for unauthorized entry by invasion of the operating mechanism and further provides for a nondestructive response to attempted unauthorized entry when the knob is forced beyond its normal operating limits.

SUMMARY OF THE INVENTION

In light of the needs expressed above, it is an object of this invention to provide a door lockset having interior bearing structure for supporting the elements thereof in a sturdy manner.

Another object of this invention is to provide a door lockset which reduces the opportunity for unauthorized entry through invasion of the lockset operating mechanism.

Still another object of this invention is to provide a door lockset which allows for a nondestructive reaction to elements of the lockset when forced entry is attempted by twisting the knob of the lockset beyond its normal operating limits.

With these and other objects in mind, this invention contemplates a door lockset designed for assembly with a door and including a latch bolt and a bolt operating mechanism coupled to the bolt. An operator is coupled to the bolt operating mechanism and movable for actuating the bolt operating mechanism to move the bolt. A support is attached to the operator for movement therewith. A first bearing member is formed with a first bearing surface which is positioned adjacent the support. A bearing support surface is spaced from the first bearing member. A second bearing member is formed with a second bearing surface which is spaced from the first bearing surface and the support and which is positioned adjacent the bearing support surface. Fastening elements are provided for retaining the first bearing member and the second bearing member in assembly with the door and in spaced position relative to each other to provide spaced bearing support for the door lockset.

DETAILED DESCRIPTION OF THE PREFERRED EMBODIMENT

Figure 1:
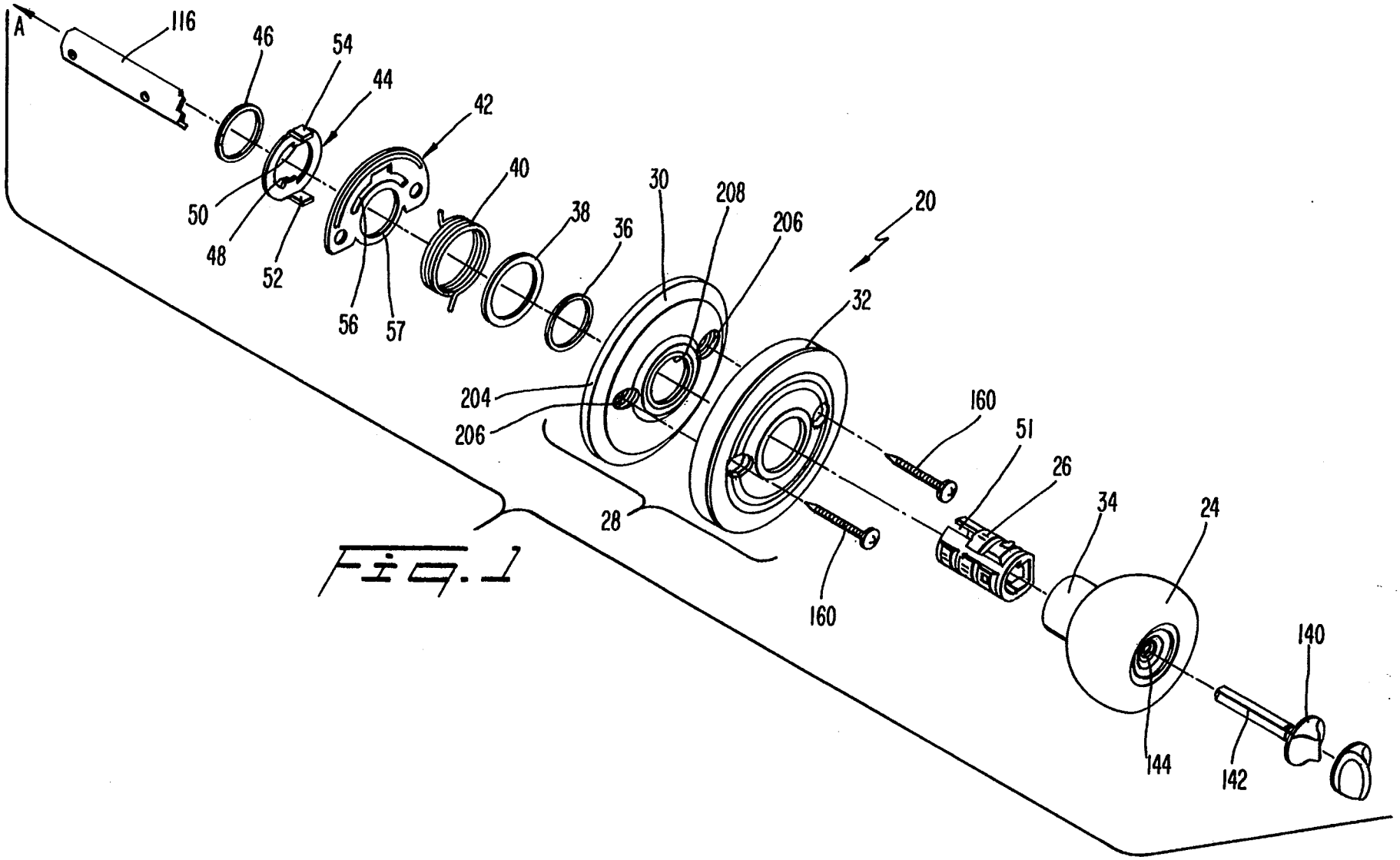
FIGS. 1, 2 and 3 are exploded views which, when combined, illustrate elements of a lockset embodying certain principles of the invention.
Figure 2:
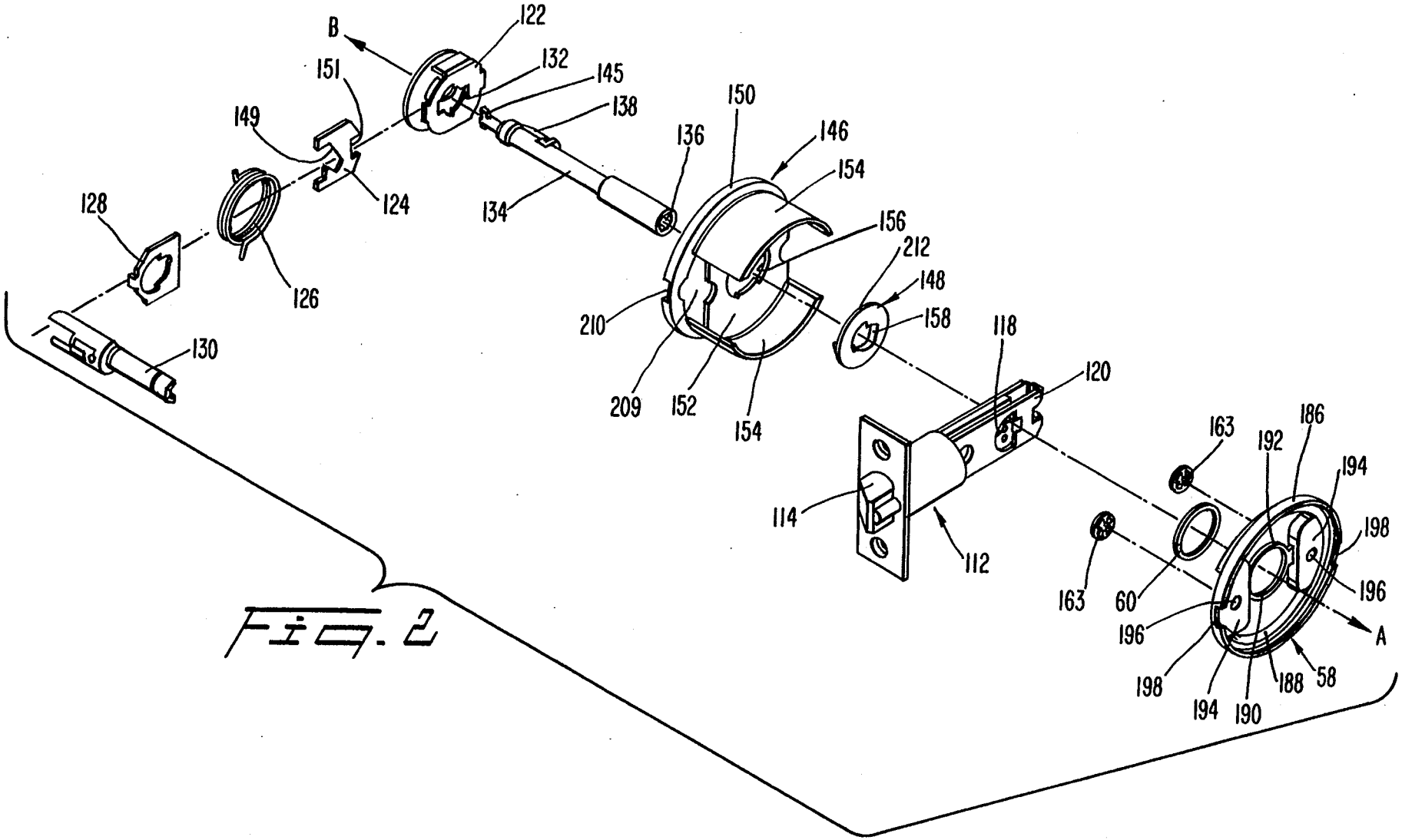
Figures 3, 5:
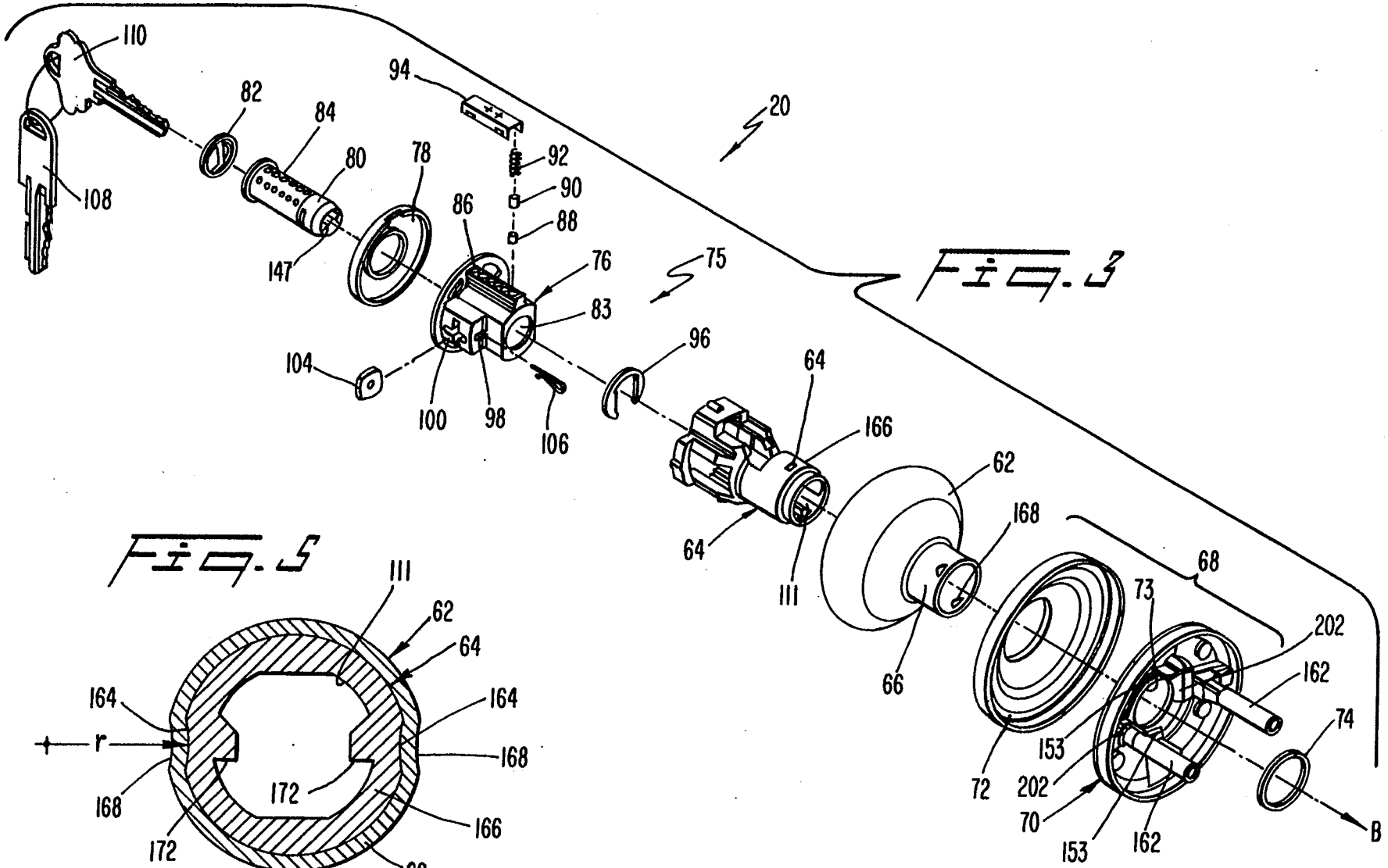
FIG. 5 is a sectional view showing the assembly of a knob sleeve with an insert of the lockset of FIG. 1 embodying certain principle of the invention.

FIGS. 1, 2 and 3 illustrate collectively an exploded view of a door lockset 20. To illustrate the complete exploded view of lockset 20, FIGS. 1 and 2 are to be linked at centerline arrowheads "A" and FIGS. 2 and 3 are to be linked at centerline arrowheads "B."

Figure 4:
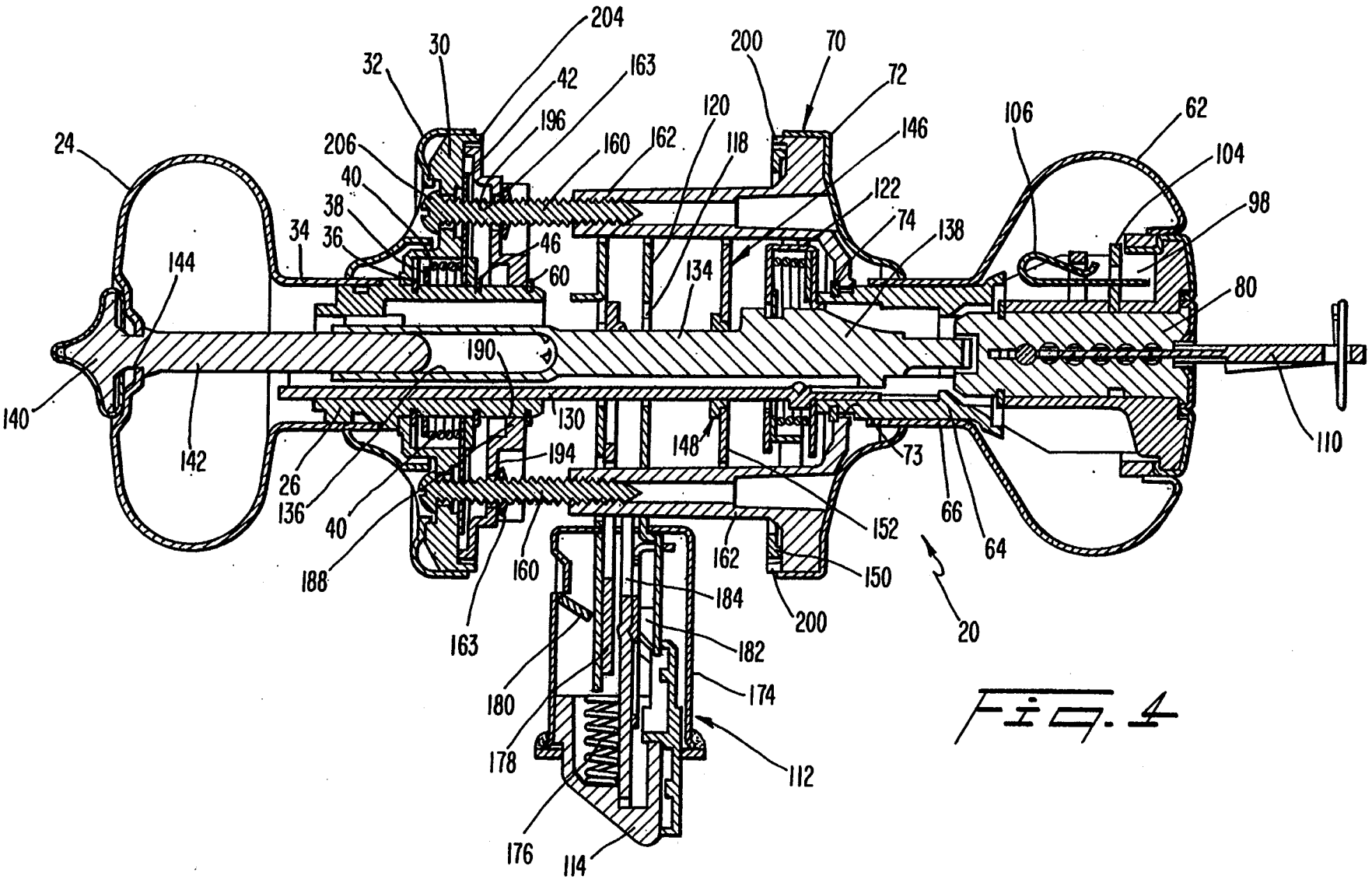
FIG. 4 is an assembly view of the lockset of FIG. 1 showing features embodying certain principles of the invention.

As shown in FIGS. 1 and 4, an interior knob 24 receives a knob insert 26 to facilitate assembly of other elements therewith. A rose assembly 28 consists of a liner 30 and a cover 32. Cover 32 is positioned over insert 26 and a shank 34 of knob 24 while liner 30 is positioned over the insert and is held in position by a retaining ring 36 located on the insert. A spacer washer 38 and a torque spring 40 are positioned on insert 26. A stop plate 42 and a torque spring housing 44 are positioned on insert 26 and held there by a retaining ring 46.

A pair of radially inward tabs 48 and 50 of housing 44 fit into accommodating slots 51 (one shown) of insert 26 so that the housing rotates when knob 24 and the insert are rotated. A pair of tabs 52 and 54 project from a side face of housing 44 and extend respectively through an arcuate slot 56 and an arcuate edge 57 of stop plate 42. A cover 58 (FIG. 2) is then positioned onto insert 26 and is held there by retaining ring 60 (FIG. 2).

As knob 24 is rotated, insert 26 and housing 44 are rotated whereby tabs 52 and 54 compress spring 40. Tabs 52 and 54 also engage the ends of the arcuate slot 56 and edge 57 to limit the rotational travel of knob 24.

As shown in FIG. 3, an exterior knob 62 is designed to receive a knob insert 64 through an opening in the front of the knob and extends partially through an inward end of a shank 66 of the knob. A rose assembly 68, consisting of a liner 70 and a cover 72, is positioned on the inward, extended end of insert 64 so that an opening 73 of the liner is positioned on the insert and the rose assembly is held there by a retaining ring 74.

Also shown in FIG. 3 is a lock cylinder assembly 75 which includes a cylinder body 76, a cylinder cover 78, a plug 80 and a plug cover 82. Plug 80 is inserted into a cylindrical opening 83 of cylinder body 76 so that tumbler pin holes 84 of the plug align with tumbler pin holes 86 of the body. A bottom pin 88, a top pin 90 and a spring 92 are positioned within each of the aligned holes 84 and 86. A cover 94 is positioned over the top of the holes 86 of the body. A clip 96 is placed over the inward end of plug 80 to retain the plug with body 76.

Cylinder body 76 is formed with a lateral housing 98. Housing 98 is formed with a slot 100 which communicates with central opening 83 formed axially through body 76. A locking bar 104 is located within slot 100 and is biased by a hair-pin spring 106 toward opening 83. A slot (not shown) is formed in a portion of the peripheral wall of plug 80 and is positionable with bar 104, and with the use of a slotted removal key 108, to assemble and disassemble cylinder assembly 75 with insert 64 and knob 62. A regular pass key 110, without a slot in the blade, is used in the conventional manner to turn plug 80 within cylinder body 76.

Cylinder assembly 75 is assembled within a through opening 111 of insert 64 at the outboard end thereof and thereby within the outboard end of knob 62.

As shown in FIG. 2, a door latch assembly 112, including a bolt 114, is positioned to receive a first half-round spindle 116 (FIG. 1) through an opening 118 in a rear frame 120 of the assembly. Spindle 116 is coupled to and driven by knob 24 and the drive elements illustrated in FIG. 1. A lock housing 122 is in axial alignment with the previously described elements of lockset 20 and provides an enclosure for a locking slide 124, a detent spring 126 and a detent slide 128. A second half-round spindle 130 extends through an opening 132 in housing 122 and is coupled to knob 62 for control of rotation of the spindle. Spindle 130 also extends into opening 118 of latch assembly 112.

A round spindle 134 is formed with a square opening 136 at one end thereof and cam ramp 138 near the other end thereof. As viewed in FIG. 1, a turn button 140 has a square shank 142 which is located within an axial opening 144 of knob 24 and into square opening 136 of spindle 134. The opposite end of round spindle 134 is formed with a cross link 145 which is inserted into an axial opening 147 (FIG. 3) in the inboard end of plug 80. Referring to FIGS. 1, 2 and 3, cam ramp 138 is located within opening 132 of housing 122. When turn button 140 is rotated to lock lockset 20 from the interior side of a related door, or plug 80 is rotated to a locked position from the exterior side of the door, cam ramp 138 is positioned to prevent rotation of half-round spindle 130 by an attempt to rotate exterior knob 62. This locking action is accomplished by cam ramp 138 engaging a follower surface 149 of locking slide 124 to move the slide so a notch 151 formed in the slide is positioned about a post extending from the inboard side of liner 70.

It is noted that the ends of spring 126 rest normally against adjacent spaced sides of a pair of spaced lugs 153 (FIG. 3) which extend in an axial direction from the inboard face of liner 70. When knob 62 is operated, one or the other of the ends of spring 126 are moved toward the adjacent-most post 162. If rotation of spindle 130 is not limited otherwise, the ends of spring 126 could engage the adjacent-most post 162 which would serve to limit normal operation of knob 62.

As shown in FIG. 2, a security shield 146 and a bearing 148 are located in axial alignment with other elements. Shield 146 is mounted in a fixed position and is formed with a circular rim 150, a base plate 152, and a pair of arcuate deflectors 154. Base plate 152 is formed with an opening 156 for receipt of a portion bearing 148.

In particular, half round spindle 130 is positioned through an opening 158 of bearing 148 and engages surfaces within the bearing opening to rotate the bearing upon rotation of the spindle. Bearing 148 is formed with lugs 159 (FIGS. 8 and 9) which engage surfaces 161 (FIG. 6) within opening 156 of base plate 152 to limit the rotary movement of the bearing. This limits the rotary movement of spindle 130 and, thereby, of exterior knob 62. As viewed in FIG. 6, a pair of projections 165 having curved surfaces 167 are formed radially inwardly from opposed sides of opening 156 and provide for surfaces 161. Thus, opening 156 has a large diameter portion formed by the vertically spaced walls of the opening as viewed in FIG. 6 and a small diameter portion formed by oppositely spaced inward projections 165.

As shown in FIG. 4, a pair of screws 160 (FIG. 1) are positioned through openings formed in rose cover 32, rose liner 30, stop plate 42, cover 58, shield 146, door latch assembly 112 and into a pair of internally threaded posts 162 which extend from the inner face of rose liner 70.

Referring to FIGS. 3 and 5, a pair of diametrically opposed curved dimples 164 are formed in the outer surface of the periphery of an inward sleeve 166 of insert 64. Also, a pair of diametrically opposed curved projections 168 are formed radially inwardly in shank 66 of knob 62. Upon assembly, the curved projections 168 of knob 62 are positioned within the, curved dimples 164 of insert 64 to retain the knob with the insert. When a rotary force above a prescribed level is applied to knob 62, projections 168 move out of dimples 164 to allow the knob to slip or rotate independently of insert 64.

The components of lockset 20 can be assembled in two subassemblies at the manufacturing location. For example, a first subassembly includes the interior portion of lockset 20 containing interior knob 24 and the elements of FIG. 1, and also containing cover 58 and retaining ring 60. After assembly of these components, screws 160 are inserted through the aligned openings of the components and project from cover 58 in the manner illustrated in FIG. 4. Thereafter, a pair of washer-like plastic retainers 163 (FIGS. 4 and 10) are placed over the threaded ends of screws 160 and are moved adjacent cover 58 to retain the screws in place. Screws 160 are supported by the holes of liner 30 and cover 58 at spaced locations along the length of the screws so that the screws do not sag and pointed ends thereof are held in place and alignment for ready assembly within threaded posts 162.

A second subassembly includes exterior knob 62, together with the other components of FIG. 3, and further includes lock housing 122, slide 124, spring 126, slide 128, half-round spindle 130, round spindle 134, shield 146 and bearing 148.

In the past, knobs have been assembled with associated inserts by staking the knob sleeve to the insert. When unauthorized entry is attempted by turning the knob beyond its normal operating limit, the area of staked connection would be destroyed and the knob would thereafter slip relative to the insert to preclude unauthorized entry. In this situation, portions of the lockset are destroyed and would have to be replaced. This could involve the ordering of replacement parts with the attendant disassembly and reassembly of the lockset, or the purchase of a new lockset and the attendant removal of the damaged lockset and assembly of the new lockset.

As shown in FIG. 5, the pair of curved dimples 164 formed in sleeve 166 of insert 64 are each formed with a shallow depth with curving ramps which extend with a slight rise from the base of the dimple to the outer periphery of sleeve 166. The curvature is determined by an arc of a circle which has a radius represented by the letter "r." In the preferred embodiment, the radius for the arc which relates to dimples 164 is 0.188 inch. Curved projections 168 which are formed inwardly in sleeve 166 of insert 64 are formed with a curvature complementary to dimples 164 determined by the value of radius "r" minus the thickness of sleeve 166. In the preferred embodiment the thickness of sleeve 166 is 0.025 inch.

With the shallow curvature, there is sufficient frictional contact between dimples 164 and projections 168 to retain knob 62 in assembly with insert 64 during instances when the knob is used in normal fashion to retract latch bolt 114. If forcible entry is attempted by twisting knob 62 beyond prescribed limits, projections 168 will be guided out of the shallow dimples 164 and onto the outer periphery of sleeve 166. This action does not destroy dimples 164 or projections 168 but allows knob 62 to rotate freely with respect to insert 64. Eventually, projections 168 could be re-inserted into dimples 164 and knob 62 thereby reassembled with insert 64 for normal use.

Referring further to FIG. 5, a pair of pedestals 172 are formed along opposite wall portions within opening 111 of insert 64. Half-round spindle 130 is positioned within opening 111 of insert 64 with portions of the spindle engaging pedestals 172. Upon rotation of knob 62 in either direction, the pedestals 172 engage and urge spindle 130 to revolve about the axis of lockset 20 whereby bolt 114 is retracted.

Insert 26 is formed with an opening and pedestals in the same manner that insert 64 is formed with opening 111 and pedestals 172. Thus, when knob 24 is rotated, half-round spindle 116 revolves about the axis of lockset 20 also to retract bolt 114.

As shown in FIG. 4, door latch assembly 112 includes bolt 114 mounted in a case 174 and extending from one end thereof. Frame 120 extends from the opposite end of case 174. A spring 176 normally urges bolt 114 outwardly of case 174. When either half-round spindle 116 or half-round spindle 130 are operated, a slide 178 located within frame 120 is moved in a direction away from case 174 and moves a latch cam 180 therewith. Latch cam 180 engages and moves a pair of followers 182 (one shown) to move a bolt extender 184 whereby bolt 114 is retracted into case 174.

As further shown in FIGS. 2, 4, 11 and 12, cover 58 is formed with a radially outward flange 186 and a hub 188 which is joined integrally with the flange. Hub 188 is formed with an axial opening 190 with a reinforcing rib 192 on the inner side of the hub. A pair of recessed areas 194 are formed inwardly in hub 188 and are formed with holes 196 for the passage of screws 160 therethrough. A pair of diametrically opposed slots 198 (FIGS. 1 and 11) are formed in flange 186.

As shown in FIGS. 3 and 4, liner 70 is formed in a disk-like configuration with a circular sidewall or rim 200. A pair of lugs 202 (FIG. 3) extend radially inwardly from diametrically opposite sides of rim 200 and are located between the rim and the bases of threaded posts 162.

In similar fashion, liner 30 is formed with a rim 204 (FIGS. 1 and 4) and a pair of lugs (not shown) similar to lugs 202. During assembly of the elements of lockset 20, cover 58 is positioned with respect to liner 30 so that flange 186 fits under and radially inside of rim 204. This precludes any radially lateral movement of liner 30 and cover 58 relative to each other. Also, slots 198 of cover 58 are located over the lugs of liner 30 to preclude relative rotation therebetween and also to locate a pair of screw holes 206 (FIGS. 1 and 4) of the liner with screw holes 196 of the cover.

With this arrangement, a central opening 208 (FIG. 1) of liner 30 provides a first bearing having a surface adjacent insert 26 while opening 190 of cover 58 provides a second bearing having a surface adjacent a bearing support surface on the insert which is spaced from the first bearing. It is noted that insert 26 is of sufficient length to receive the various elements assembled therewith. This includes liner 30 and cover 58 which provide the spaced bearing facility for the interior knob assembly.

In assembly, hub 188 of cover 58 is located within a complementary hole (not shown) in the door which precludes radially lateral movement of the cover relative to the axis of the hole. Since liner 30 and cover 58 cannot not move radially laterally relative to each other as described above, the liner is likewise precluded from radial movement relative to the axis of the door hole. Thus, the opportunity for lockset 20 to sag and expose the door hole is essentially eliminated. This precludes the opportunity for unauthorized entry by placement of an implement through the exposed door hole and subsequent operations of latch operating facilities.

Further, knob 24 is mounted on insert 26 which is provided with bearing support, as described above, by liner 30 and cover 58 at openings 208 and 190, respectively. By virtue of the spaced bearing support for insert 26, wobble of knob 24 is essentially precluded.

Referring to FIGS. 2, 4, 6 and 7, shield 146 is formed with passageways 209 to facilitate positioning of the shield over threaded posts 162 of liner 70. Further, shield 146 is formed with a pair of slots 210 on diametrically opposite sides of an outboard face of rim 150.

During assembly of shield 146 with liner 70, rim 150 of the shield is positioned within rim 200 of the liner so that there can be no relative radially lateral movement between the shield and the liner. Further, slots 210 of shield 146 are guided over lugs 202 of liner 70 to preclude relative rotation between the shield and liner. Also, this ensures proper alignment of liner 70 and shield 146 in addition to the alignment provided by threaded posts 162 and passageways 209.

With this arrangement, half-round spindle 130 and round spindle 134 extend through opening 156 of shield 146 in a direction away from knob 62 to expose a free end of the spindles. However, opening 156 is larger than the combined cross section of spindles 130 and 134 so that no portion of the spindles engage the opening.

Figures 6, 7, 8, 9, 10, 11, 12:
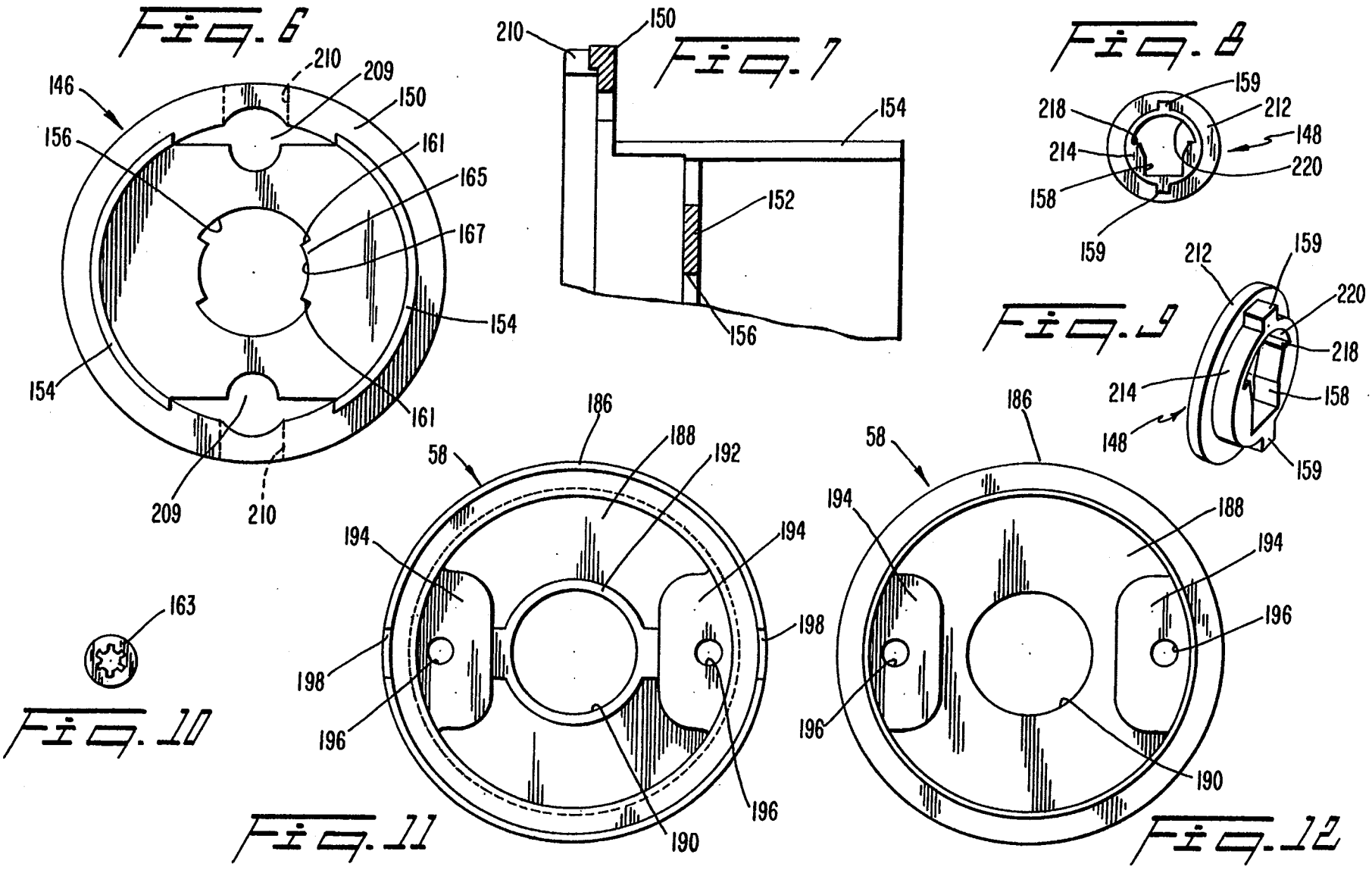
FIGS. 6 and 7 are views showing a security shield embodying certain principles of the invention.
FIG. 8 and 9 are views showing a bearing embodying certain principle of the invention.
FIG. 10 is a front view of a screw retainer.
FIGS. 11 and 12 are views showing a cover embodying certain principles of the invention.

As viewed in FIGS. 2, 8 and 9, bearing 148 is formed with a flange 212 and a hub 214 extending from one side thereof with the lugs 159 extending radially outwardly from the hub. Opening 158 is formed through bearing 148 and forms a pair of shoulders 218 and a generally semi-circular portion 220.

In assembly, with hub 214 facing toward base plate 152, bearing 148 is positioned on the free end of spindle 130 and moved over spindles 130 and 134 whereby spindle 130 fits into the semi-circular portion 220 with edges of spindle 130 being located adjacent shoulders 218. Spindle 134 is located centrally within opening 158 but does not engage any of the wall thereof. Bearing 148 is moved further over spindles 130 and 134 whereby hub 214 fits into the small diameter of opening of shield 146 formed by oppositely spaced curved surfaces 167. Also, lugs 159 fit into the space provided by the large diameter of opening 156 and are in position to engage surfaces 161. However, half-round spindle 130 is adjacent the surface of semi-circular portion 220 of opening 158 which forms a bearing support surface.

With the subassembly complete, a first bearing is provided by liner 70 with a first bearing surface provided by opening 73 thereof which is adjacent insert 64. A second bearing is provided by shield 146 with a second bearing surface being provided by the surface of the generally semi-circular portion 220 of opening 156 of bearing 148. A bearing support surface is provided by half-round spindle 130. It is noted that, in this arrangement, the first bearing is positioned adjacent insert 64 and the second bearing is positioned adjacent half-round spindle 130 which is spaced from the insert. By using this arrangement, first and second bearings are provided to essentially preclude the possibility of wobble of knob 62.

Further, deflectors 154 of shield 146 fit snugly into the door hole and preclude radially lateral movement relative to the axis of the door hole. This arrangement essentially precludes sagging of lockset 20 to the extent that the door hole is exposed with its attendant disadvantages as described above.

Also, deflectors 154 extend over the internal mechanism within the door which operates bolt 114 to allow opening of the door. Deflectors 154 provide additional security by essentially precluding unauthorized placement of an implement behind liner 70 and into the door hole to operate the internal mechanism.

When knob 62 is operated, pedestals 172 (FIG. 5) of insert 64 engage edges of half-round spindle 130 and revolve the spindle. As the spindle 130 is moved, bearing 148 is moved therewith until lugs 159 engage surfaces 161 of shield 146 to preclude further turning of knob 62. Thus, bearing 148 functions as a bearing element and also serves as a travel limiting element for spindle 130 and knob 62.

In general, the above described embodiments are not to be construed as limiting the breadth of the present invention. Modifications, and other alternative constructions, will be apparent which are within the spirit and scope of the invention as defined in the appended claims.

What is claimed is:

1. A door lockset for assembly with a door, which comprises:

a latch bolt;

a bolt operating mechanism coupled to the bolt;

an operator subassembly assembled independently of the bolt and bolt operating mechanism, which comprises:

an operator located for coupling to the bolt operating mechanism and movable for actuating the bolt operating mechanism to move the bolt;

a support attached to the operator for movement therewith;

a first bearing member having a first bearing surface positioned adjacent the support;

a bearing support surface spaced from the first bearing member;

a second bearing member having a second bearing surface spaced from the first bearing surface and positioned adjacent the bearing support surface; and fastening and holding elements for retaining the first bearing member and the second bearing member in assembly with the door and in a spaced-apart position to provide bearing support for the door lockset.

2. The door lockset as set forth in claim 1, which further comprises:

a spindle interposed between the support and the bolt operating mechanism; and a portion of the spindle spaced from the support forming the bearing support surface.

3. A door lockset for assembly with a door, which comprises:

a latch bolt;

a bolt operating mechanism coupled to the bolt;

an operator coupled to the bolt operating mechanism and movable for actuating the bolt operating mechanism to move the bolt;

a support attached to the operator for movement therewith;

a first bearing member having a first bearing surface positioned adjacent the support;

a bearing support surface spaced from the first bearing member;

a second bearing member having a second bearing surface spaced from the first bearing surface and positioned adjacent the bearing support surface;

fastening and holding elements for retaining the first bearing member and the second bearing member in assembly with the door and in a spaced-apart position to provide bearing support for the door lockset; and a bearing insert interposed between the second bearing member and the bearing support surface.

4. A door lockset for assembly with a door, which comprises:

a latch bolt;

a bolt operating mechanism coupled to the bolt;

an operator coupled to the bolt operating mechanism and movable for actuating the bolt operating mechanism to move the bolt;

a support attached to the operator for movement therewith;

a first bearing member having a first bearing surface positioned adjacent the support;

a bearing support surface spaced from the first bearing member;

a second bearing member having a second bearing surface spaced from the first bearing surface and positioned adjacent the bearing support surface;

fastening and holding elements for retaining the first bearing member and the second bearing member in assembly with the door and in a spaced-apart position to provide bearing support for the door lockset; and wherein the second bearing member has portions thereof which are positioned within a recess of the first bearing member so that the first and second bearing members are precluded from moving laterally with respect to each other.

5. The door lockset as set forth in claim 4 wherein the door has a hole formed therein and the second bearing member is formed with structure which is complementary to and fits into the hole of the door to preclude lateral movement of the second bearing member.

6. A door lockset for assembly with a door, which comprises:

a latch bolt;

a bolt operating mechanism coupled to the bolt;

an operator coupled to the bolt operating mechanism and movable for actuating the bolt operating mechanism to move the bolt;

a support attached to the operator for movement therewith;

a first bearing member having a first bearing surface positioned adjacent the support;

a bearing support surface spaced from the first bearing member;

a second bearing member having a second bearing surface spaced from the first bearing surface and positioned adjacent the bearing support surface;

fastening and holding elements for retaining the first bearing member and the second bearing member in assembly with the door and in a spaced-apart position to provide bearing support for the door lockset; and wherein the support is an insert which is positioned within a portion of the operator and wherein the first bearing member and the second bearing member are positioned adjacent spaced locations of the insert which provides spaced bearing support for the first and second bearing members.

7. The door lockset as set forth in claim 6 wherein spaced portions of the first and second bearing members are formed with aligned holes for supporting therein at least one screw at spaced locations so that the screw is retained in accurate axial alignment with the aligned holes.

8. The door lockset as set forth in claim 7 which further comprises a screw retainer to hold the screw in assembly with the spaced bearing members pending assembly of the screw with a threaded receptor of the lockset.

9. A door lockset for assembly with a door, which comprises:

a latch bolt;

a bolt operating mechanism coupled to the bolt;

an operator coupled to the bolt operating mechanism and movable for actuating the bolt operating mechanism to move the bolt;

a spindle having a half-round cross section interposed between the operator and the bolt operating mechanism and movable with movement of the operator;

an attachment formed with an opening of a shape complementary to the cross section of the spindle for form fit of the spindle within the opening of the attachment for movement therewith and the attachment formed with a projection extending therefrom; and a stop surface positioned fixedly in a path of movement of the projection for limiting movement of the attachment and spindle and thereby the operator.

10. The door lockset as set forth in claim 9 wherein the attachment is formed by an insert which is formed with a central opening for frictional receipt of the spindle and with at least one surface within the opening which engages an edge of the spindle for movement with the spindle, and the projection is at least one lug which extends from a portion of the insert.

11. The door lockset as set forth in claim 9 wherein the projection includes a pair of spaced lugs which extend from one surface of the attachment.

12. A door lockset for assembly with a door, which comprises:

a latch bolt;

a bolt operating mechanism coupled to the bolt;

an operator coupled to the bolt operating mechanism and movable for actuating the bolt operating mechanism to move the bolt;

a spindle interposed between the operator and the bolt operating mechanism and movable with movement of the operator;

an attachment positioned on the spindle for movement shape complementary to the cross section of the spindle for form therewith and formed with a projection extending therefrom;

a stop surface positioned fixedly in a path of movement of the projection for limiting movement of the attachment and spindle and thereby the operator;

a plate held in fixed position in its assembly with the door lockset and with the door;

an opening formed through the plate;

the spindle being located for rotation within and through the opening of the plate;

at least one surface of the plate extending into the opening of the plate which forms the stop surface;

the attachment formed by an insert having an opening for receipt of the spindle;

the insert mounted within the opening of the plate for rotary movement with the spindle and within the opening of the plate; and the projection formed by at least one lug which also extends into the opening of the plate in a path including the stop surface for limiting rotary movement of the insert, spindle and operator upon rotation of the operator.

13. The door lockset as set forth in claim 12, which further comprises:

a pair of spaced deflectors extending from one side of the plate and about the bolt operating mechanism to shield the mechanism from tampering.

14. The door lockset as set forth in claim 12 wherein the opening of the plate is formed with a large diameter portion formed by diametrically and oppositely spaced walls; the opening of the plate is formed further with a small diameter portion formed by diametrically and oppositely spaced projections which extend into the opening of the plate and which have curved interfacing edges.

15. The door lockset as set forth in claim 14 wherein the insert is located for rotation within the small diameter portion as defined by the curved interfacing edges of the projections and the lug is located for movement in the large diameter portion.

16. The door lockset as set forth in claim 12 wherein the insert is formed with a flange which engages the plate adjacent the opening of the plate to preclude movement of the insert beyond the plate.

17. A door lockset for assembly with a door, which comprises:

a latch bolt;

a bolt opening mechanism coupled to the bolt;

an operator for actuating the bolt operating mechanism to move the bolt;

the operator formed with a hand-gripping portion and a shank integrally joined with the hand-gripping portion at one end of the shank, an opposite end of the shank being a free end;

a coupler attached to the shank of the operator for facilitating the coupling of the operator to the bolt operating mechanism and formed with a first end and a second end;

the coupler being formed with a depression of a prescribed configuration intermediate to and spaced from the first and second ends thereof;

the shank of the operator being formed with a projection of the prescribed configuration intermediate the one end and the free end thereof and in complementary assembly with the depression of the coupler; and the depression of the coupler having a coupler surface portion in engagement with an operator surface portion of the projection of the operator whereby normal operation of the operator results in movement of the coupler therewith.

18. The door lockset as set forth in claim 17 wherein the depression of the coupler is a dimple formed in an exterior surface of the coupler and the projection of the operator extends inwardly from an interior surface of the operator and fits in complementary fashion into the dimple.

19. The door lockset as set forth in claim 18 wherein the dimple is formed with a shallow depression having curved ramps extending from opposite sides of a base of the shallow depression and the projection of the operator has complementary structure which fits into the shallow depression.

20. The door lockset as set forth in claim 17 wherein frictional engagement between the coupler surface portion and the operator surface portion allows the coupler and the operator to move together when a force up to a prescribed level is applied to the operator and allows the operator surface portion to glide in a non-destructive manner out of engagement with the coupler surface portion when a force above the prescribed level is applied to the operator whereafter the operator is movable freely of the coupler.

* * * * *